US010874137B2

(12) United States Patent
Qiu

(10) Patent No.: US 10,874,137 B2
(45) Date of Patent: Dec. 29, 2020

(54) ATOMIZER AND ELECTRONIC CIGARETTE THEREOF

(71) Applicant: CHANGZHOU JWEI INTELLIGENT TECHNOLOGY CO., LTD., Changzhou (CN)

(72) Inventor: Weihua Qiu, Zhangzhou (CN)

(73) Assignee: CHANGZHOU JWEI INTELLIGENT TECHNOLOGY CO., LTD., Changzhou (CN)

( * ) Notice: Subject to any disclaimer, the term of this patent is extended or adjusted under 35 U.S.C. 154(b) by 337 days.

(21) Appl. No.: 16/105,928

(22) Filed: Aug. 20, 2018

(65) Prior Publication Data

US 2018/0352865 A1 Dec. 13, 2018

Related U.S. Application Data

(63) Continuation of application No. PCT/CN2017/074103, filed on Feb. 20, 2017.

(30) Foreign Application Priority Data

Feb. 27, 2016 (CN) ..... 2016 1 0110015

(51) Int. Cl.
*A24F 47/00* (2020.01)
*A24F 15/015* (2020.01)
*A24F 40/485* (2020.01)

(52) U.S. Cl.
CPC ..... *A24F 15/015* (2020.01); *A24F 40/485* (2020.01); *A24F 47/008* (2013.01)

(58) Field of Classification Search
CPC ..... A24F 15/015
See application file for complete search history.

(56) References Cited

U.S. PATENT DOCUMENTS

2012/0325228 A1 12/2012 Williams ..... 131/328
2014/0182610 A1 7/2014 Liu ..... 131/329
(Continued)

FOREIGN PATENT DOCUMENTS

CN 204146331 U 2/2015
CN 204157651 U 2/2015
(Continued)

OTHER PUBLICATIONS

The International Search Report of corresponding International PCT Application No. PCT/CN2017/074103, dated Mar. 29, 2017.
(Continued)

*Primary Examiner* — James Harvey
(74) *Attorney, Agent, or Firm* — J.C. Patents

(57) ABSTRACT

Provided are an atomizer (100) and an electronic cigarette thereof, the atomizer comprising a switching device (1), a liquid storage component (3) and an atomization component. The atomization component is disposed in the liquid storage component (3), and the switching device (1) includes a movable piece (13) and a static piece (14) that are cooperatively arranged, and the movable piece (13) is capable of moving relative to the static piece (14) to make the atomizer (100) switch between two states of liquid injection and gas inflow adjustment. The movable piece (13) and the static piece (14) are each provided with a liquid inlet and a gas inlet. When the atomizer (100) is in the state of liquid injection, the gas inlets are closed to avoid a possible leakage of smoke liquid from the atomization head (5) during liquid injection due to a pressure difference when the gas inlets communicate.

16 Claims, 12 Drawing Sheets

(56) References Cited

U.S. PATENT DOCUMENTS

| | | | | |
|---|---|---|---|---|
| 2018/0029866 | A1* | 2/2018 | Scott | B65D 47/06 |
| 2018/0049470 | A1* | 2/2018 | Chen | A24F 47/008 |
| 2018/0271148 | A1* | 9/2018 | Liu | A24F 40/48 |
| 2018/0352865 | A1* | 12/2018 | Qiu | A24F 47/008 |
| 2020/0214358 | A1* | 7/2020 | Qiu | H01M 10/42 |

FOREIGN PATENT DOCUMENTS

| | | | |
|---|---|---|---|
| CN | 204635088 | U | 9/2015 |
| CN | 204742640 | U | 11/2015 |
| CN | 204837999 | U | 12/2015 |
| CN | 105559148 | A | 5/2016 |
| CN | 205512357 | U | 8/2016 |

OTHER PUBLICATIONS

The Chinese First Examination Report of corresponding China patent Application No. 201610110015.2, dated Dec. 29, 2017.

* cited by examiner

ATOMIZER AND ELECTRONIC CIGARETTE THEREOF

CROSS-REFERENCE TO RELATED APPLICATIONS

This application is a continuation of International Application No. PCT/CN2017/074103, filed on Feb. 20, 2017, which claims priority to Chinese Patent Application No. 201610110015.2, filed on Feb. 27, 2016. The disclosures of the aforementioned applications are hereby incorporated by reference in their entireties.

TECHNICAL FIELD

The present application relates to the technical field of electronic cigarettes, and in particular to an atomizer and an electronic cigarette thereof.

BACKGROUND

At present, the electronic cigarette has become a relatively mature substitute for a smoke on the market. It supplies power to the heating wire in the atomization head through a battery, so that the heating wire heats the smoke liquid to generate smog under the electric drive, thereby enabling the user to obtain a smoking experience.

Among the existing atomizers, the liquid inlet and the gas adjusting device are generally separately provided, which renders the atomizer structure complicated. In addition, when the smoke liquid injection is required for the atomizer, the smoke liquid is generally directly injected, and the user often forgets to close the gas inflow channel through the gas adjusting device, thus forgetting that the existence of the pressure difference will cause leakage of the smoke liquid in the atomization head, thereby affecting the user's normal use and experience.

SUMMARY

In view of the foregoing, the present application provides an improved atomizer and an electronic cigarette using the same in order to meet market demands.

The technical scheme adopted by the present application is: an atomizer, the atomizer including a switching device, a liquid storage component, and an atomization component. The atomization component is disposed in the liquid storage component, and the switching device is arranged at the upper part of the atomization component and seals the open end of the liquid storage component. The switching device includes a movable piece and a static piece which are cooperatively arranged, and the movable piece can move relative to the static piece to make the atomizer switch between the two states of liquid injection and gas inflow adjustment. The movable piece is provided with a movable piece liquid inlet and a movable piece gas inlet, and the static piece is provided with a static piece liquid inlet and a static piece gas inlet. When the atomizer is in the state of liquid injection, the movable piece liquid inlet and the static piece liquid inlet communicate with each other, and are connected with the liquid storage component fluidly, while the movable piece gas inlet and the static piece gas inlet are staggered to be closed; and when the atomizer is in the state of gas inflow adjustment, the movable piece gas inlet communicates with the static piece gas inlet, and the movable piece liquid inlet and the static piece liquid inlet are staggered to be closed.

Rotation of the movable piece can change the communication area of the movable piece gas inlet and the static piece gas inlet.

Further, the movable piece and the static piece are made of ceramic, and the movable piece is in smooth contact with the static piece.

Further, the movable piece and the static piece are connected via a pin, where the movable piece is provided with a pin mounting hole/pin sliding groove, and correspondingly the static piece is provided with a pin sliding groove/pin mounting hole. One end of the pin is fixed in the pin mounting hole, and the other end of the pin can reciprocate along the pin sliding groove.

Further, the switching device further includes an adjusting ring disposed on the periphery of the movable piece, which is connected with the movable piece in a relatively static manner. Rotation of the adjusting ring drives the movable piece to rotate, so as to make the atomizer switch between the state of state of gas inflow adjustment and the state of liquid injection.

Further, the atomizer further includes a connector that connects the switching device and the atomization component, the connector including a concave cavity in which the static piece is fixedly disposed.

Further, the liquid storage component includes a liquid storage chamber; a connector positioning hole is disposed on an inner wall surface of a lower end of the concave cavity; and the concave cavity communicates with the liquid storage chamber through the connector positioning hole.

Further, the connector positioning hole protrudes from the inner wall surface of the lower end of the concave cavity, and the static piece liquid inlet sleeves the periphery of the connector positioning hole.

Further, the movable piece liquid inlet is disposed on the side wall of the movable piece, and the side wall of the connector is provided with a connector liquid inlet. When the atomizer is in the state of liquid injection, the connector liquid inlet, the movable piece liquid inlet, the static piece liquid inlet and the connector positioning hole communicate, and the movable piece gas inlet and the static piece gas inlet are staggered to be closed.

Further, the atomization component includes an atomization head, a vent pipe, and an atomization sleeve. The atomization head is sleeved in the atomization sleeve; the upper end of the atomization head is fixedly connected with the lower end of the vent pipe. When the atomizer is in the state of gas inflow adjustment, the movable piece liquid inlet and the static piece liquid inlet are staggered to be closed. The external gas enters the gap between the atomization sleeve and the atomization head via the gap between the adjusting ring and the connector, movable piece gas inlet, the static piece gas inlet and the concave cavity of the connector, then finally enters the atomization head via the gas flow inlet disposed on the atomization head, carries the atomized smoke liquid and flows out from the vent pipe.

Further, the liquid storage component further includes an outer sleeve and a bottom component. The bottom component is connected to a lower end of the outer sleeve, and includes a lower cover, a silicone sealing ring and an electrode connection component, where the silicone sealing ring is disposed on the upper end of the lower cover so that the lower cover is in interference connection with the outer sleeve, and the electrode connection component is disposed at the lower end of the lower cover to electrically connect the atomization component with the power supply.

Further, the connector is disposed at an upper end of the outer sleeve, and a sealing device is disposed between the connector and the outer sleeve.

Further, a smoke liquid groove is disposed on a surface of the upper end of the lower cover, and the liquid storage chamber and the atomization component communicate with each other.

Further, the atomization component includes an atomization head, a vent pipe, and an atomization sleeve, where the atomization head is sleeved in the atomization sleeve; the upper end of the atomization head is fixedly connected with the lower end of the vent pipe; and the lower end of the atomization head is electrically connected with the electrode connection component.

Further, the vent pipe traverses the connector, the static piece and the movable piece, and is fixedly connected with a lower end of a cigarette holder connector, while a smoke gas channel of the atomization head and a smoke outlet of the cigarette holder connector communicate via the vent pipe.

Further, a gas flow inlet is disposed on a side wall of the atomization head. When the atomizer is in the state of gas inflow adjustment, the movable piece gas inlet and the static piece gas inlet communicate with the gas flow inlet, and the connector liquid inlet and the movable piece liquid inlet are staggered to be closed.

The present application provides an electronic cigarette, where the electronic cigarette includes any one of the above atomizers.

Compared to the prior art, the atomizer according to the present application includes a switching device, a liquid storage component, and an atomization component. The atomization component is disposed in the liquid storage component. The switching device includes a movable piece and a static piece that are cooperatively arranged. The movable piece can move relative to the static piece to make the atomizer switch between the two states of liquid injection and gas inflow adjustment. The movable piece and the static piece are each provided with a liquid inlet and a gas inlet, where the liquid inlets communicate with each other correspondingly in the state of liquid injection, and the gas inlets communicate with each other correspondingly in the state of gas inflow adjustment. In addition, when the atomizer is in the state of liquid injection, the gas inlets are closed to avoid a possible leakage of smoke liquid from the atomization head during liquid injection due to a pressure difference when the gas inlets communicate.

The preferred embodiments of the present application and beneficial effects thereof will be further described in detail with reference to specific embodiments.

BRIEF DESCRIPTION OF DRAWINGS

The accompanying drawings are used to provide a further understanding of the present application and constitute a part of the specification, and are used to explain the present application together with the following specific embodiments, but should not be construed as limiting the present application. In the drawings.

| Part Names and Numbers | | | |
|---|---|---|---|
| Switching device: 1 | Thread connection ring: 22 | Backstop boss: 121 | Liquid inlet: 53 |
| Connection component: 2 | Vent pipe: 23 | Backstop notch: 131 | Gas flow inlet: 54 |
| Liquid storage component: 3 | Outer sleeve: 31 | Movable piece gas inlet: 132 | Liquid storage chamber: 46 |
| Bottom component: 4 | Atomization sleeve: 32 | Movable piece liquid inlet: 133 | Concave cavity: 214 |
| Atomization head: 5 | Sealing device: 33 | Pin mounting hole: 134 | Cigarette holder: 47 |
| Cigarette holder connector: 11 | silicone sealing ring: 34 | Static piece gas inlet: 141 | Atomizer: 100 |
| Adjusting ring: 12 | Lower cover: 41 | Static piece liquid inlet: 142 | Batters: 200 |
| Movable piece: 13 | First electrode contact: 42 | Pin sliding groove: 143 | Switch: 201 |
| Static piece: 14 | Sealing ring: 43 | Connector liquid inlet: 211 | Smoke outlet: 111 |
| Lining ring: 15 | Second electrode contact: 44 | Connector positioning hole: 212 | |
| Pin: 16 | Insulation ring: 45 | Liquid absorption part: 51 | |
| Connector: 21 | Smoke liquid groove: 411 | Heat generating part: 52 | |

DESCRIPTION OF EMBODIMENTS

The specific embodiments of the present application will be described in detail below with reference to the accompanying drawings. It should be understood that the specific embodiments described herein are only used to illustrate and explain the present application and are not intended to limit the present application.

Figure 9:
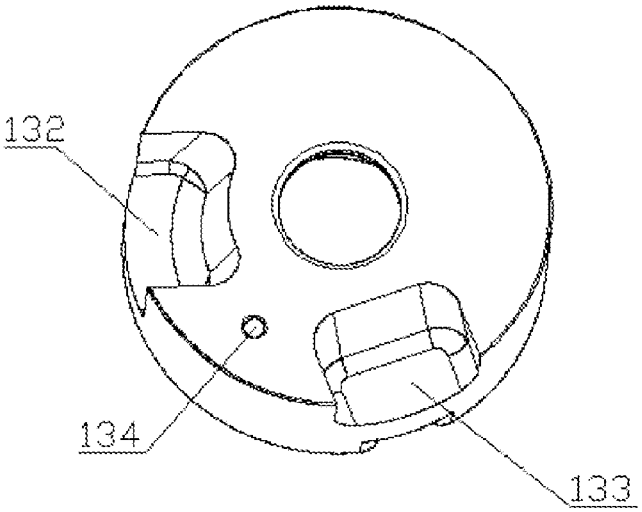
FIG. 9 is a stereogram (bottom view) of the movable piece according to FIG. 8.
Figure 10:
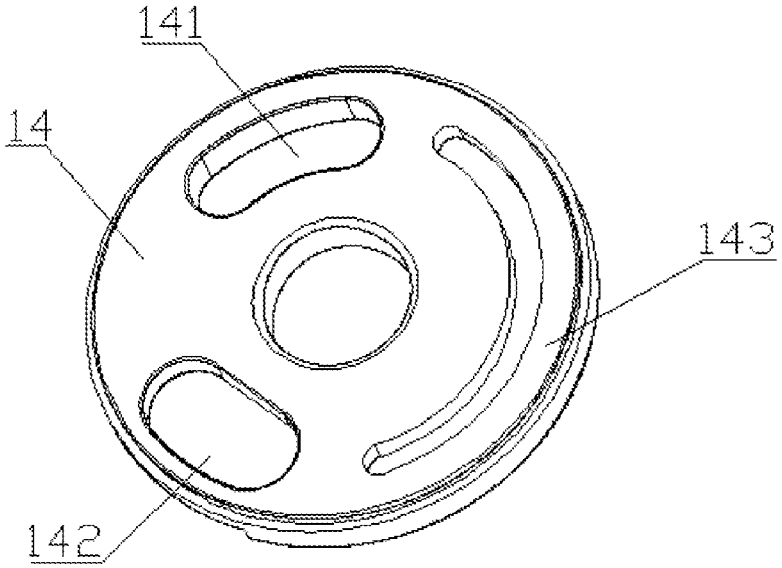
FIG. 10 is a stereogram of a static piece according to the present application.

Referring to FIG. 1 to FIG. 5, an embodiment of the present application provides an atomizer 100. The atomizer 100 includes a switching device 1, a liquid storage component 3, and an atomization component. The atomization component is disposed in the liquid storage component 3, and the switching device 1 is disposed at the upper part of the atomization component and seals the open end of the liquid storage component 3, and allows the atomizer 100 to switch between the two states of liquid injection and gas inflow adjustment. The switching device 1 of the embodiment includes a movable piece 13 and a static piece 14 which arranged in a mutually adhering manner. The movable piece 13 can move relative to the static piece 14 to switch the atomizer 100 between the two states of liquid injection and gas inflow adjustment. Preferably, according to one of the preferred implementations of the present embodiment, the movable piece 13 and the static piece 14 are both made of ceramic, and the movable piece 13 and the static piece 14 are in smooth contact with each other. The smooth contact in this embodiment refers to that the flatness of the contact surface between the movable piece 13 and the static piece 14 does not exceed 0.04 μm, and the roughness does not exceed 0.007 μm. In this embodiment, the movable piece 13 and the static piece 14 are each provided with a liquid inlet and a gas inlet, where the liquid inlets communicate with each other correspondingly in the state of liquid injection, and the gas inlets communicate with each other correspondingly in the state of gas inflow adjustment. Referring to FIG. 9 and FIG. 10, it is specifically referred to that a movable piece liquid inlet 133 and a movable piece gas inlet 132 are disposed on the side wall of the movable piece 13, and a static piece liquid inlet 142 and a static piece gas inlet 141 are disposed on the static piece 14. When the atomizer 100 is in the state of liquid injection, the movable piece liquid inlet 133 and the static piece liquid inlet 142 communicate with each other and are connected with the liquid storage component 3; when the atomizer 100 is in the state of gas inflow adjustment, the movable piece gas inlet 132 and the static piece gas inlet 141 communicate with each other, and are connected with the atomization component. Rotation of the movable piece 13 adjusts the communication area of the movable piece gas inlet 132 and the static piece gas inlet 141, thereby adjusting the gas inflow.

Referring to FIG. 1, FIG. 4, FIG. 7 and FIG. 8, the switching device 1 of the present embodiment further includes an adjusting ring 12 disposed on the periphery of the movable piece 13, and the adjusting ring 12 and the movable piece 13 are relatively statically connected to each other. Specific to an implementation of the embodiment, a backstop boss 121 is provided on the inner side edge of the adjusting ring 12, and a backstop notch 131 is provided on the upper surface of the movable piece 13. During the assembly, the backstop boss 121 is stuck into the stop notch 131 to enable a relatively static connection between the adjusting ring 12 and the movable piece 13. It can be understood that, of course, a transposition can also be made between the backstop boss 121 and the backstop notch 131 with the same principle as described above, and will not be repeated here. In the present embodiment, the atomizer 100 is preferably designed to be substantially cylindrical. Therefore, the adjusting ring 12 and the movable piece 13 are also cylindrical or approximately cylindrical. During the operation of the switching device 1, the movable piece 13 can be driven to rotate only by rotating the adjusting ring 12, so that the atomizer 100 can switch between the two states of liquid injection and gas inflow adjustment.

Figure 8:
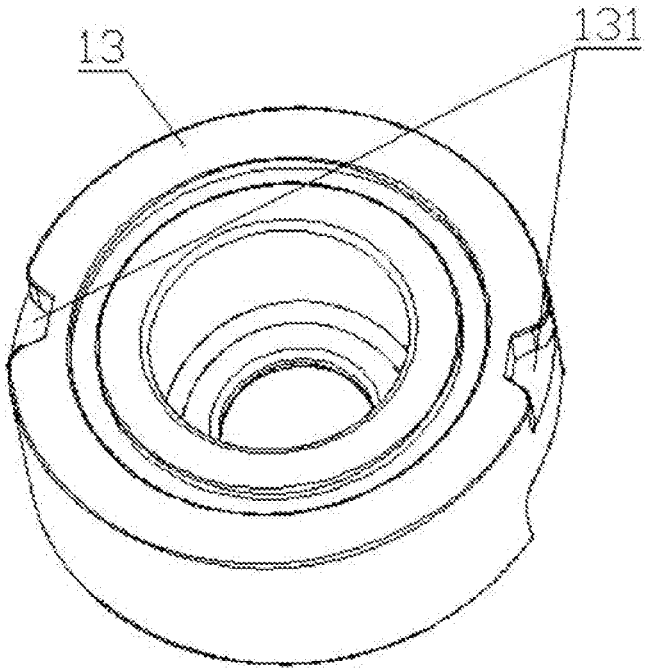
FIG. 8 is a stereogram (top view) of a movable piece according to the present application.

Referring to FIG. 8 to FIG. 10, according to one implementation of the present embodiment, the movable piece 13 and the static piece 14 are connected via a pin 16. The movable piece 13 is provided with a pin mounting hole 134, and the static piece 14 is provided with a pin sliding groove 143. One end of the pin 16 is fixed in the pin mounting hole 134, and the other end can reciprocate along the pin sliding groove 143. It can be understood that a transposition can also be made between the pin sliding groove 143 and the pin mounting hole 134, that is, the pin sliding groove 143 is disposed on the movable piece 13, while the pin mounting hole 134 is disposed on the static piece 14.

Figure 1:
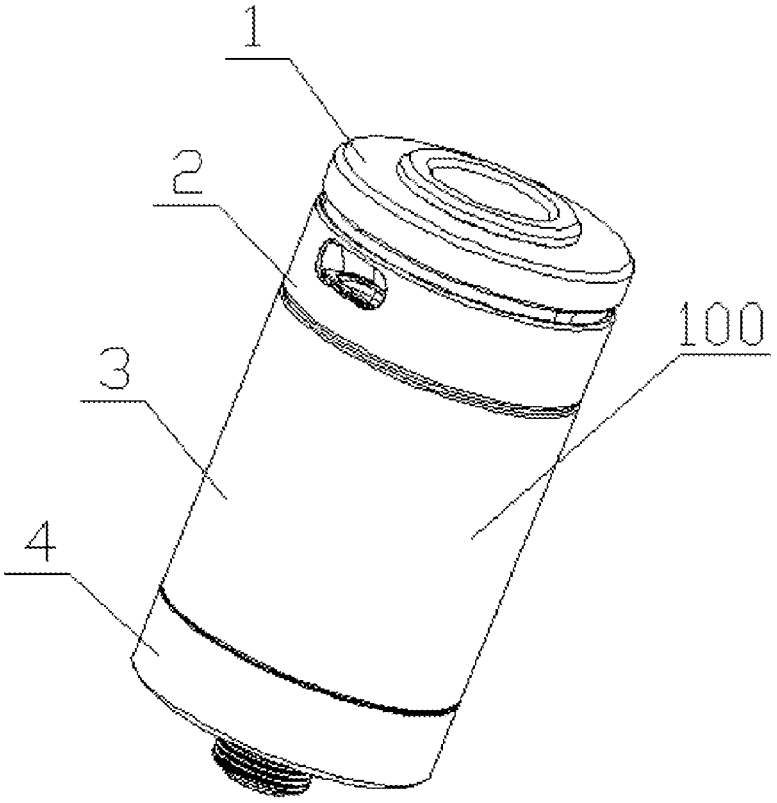
FIG. 1 is a stereogram of an atomizer according to the present application.
Figure 2:
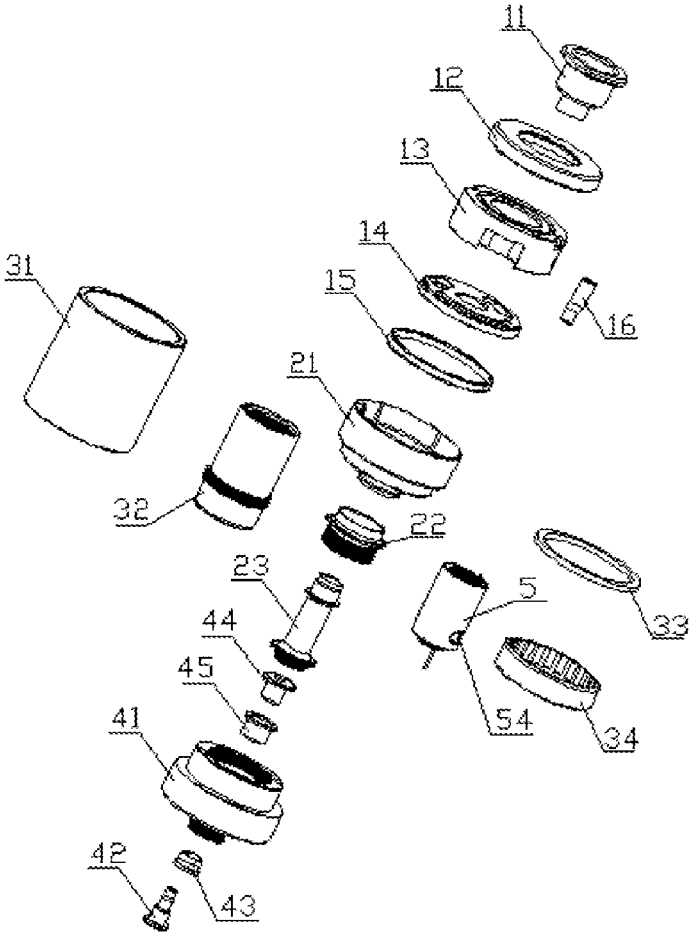
FIG. 2 is an exploded view of the atomizer according to FIG. 1.
Figure 3:
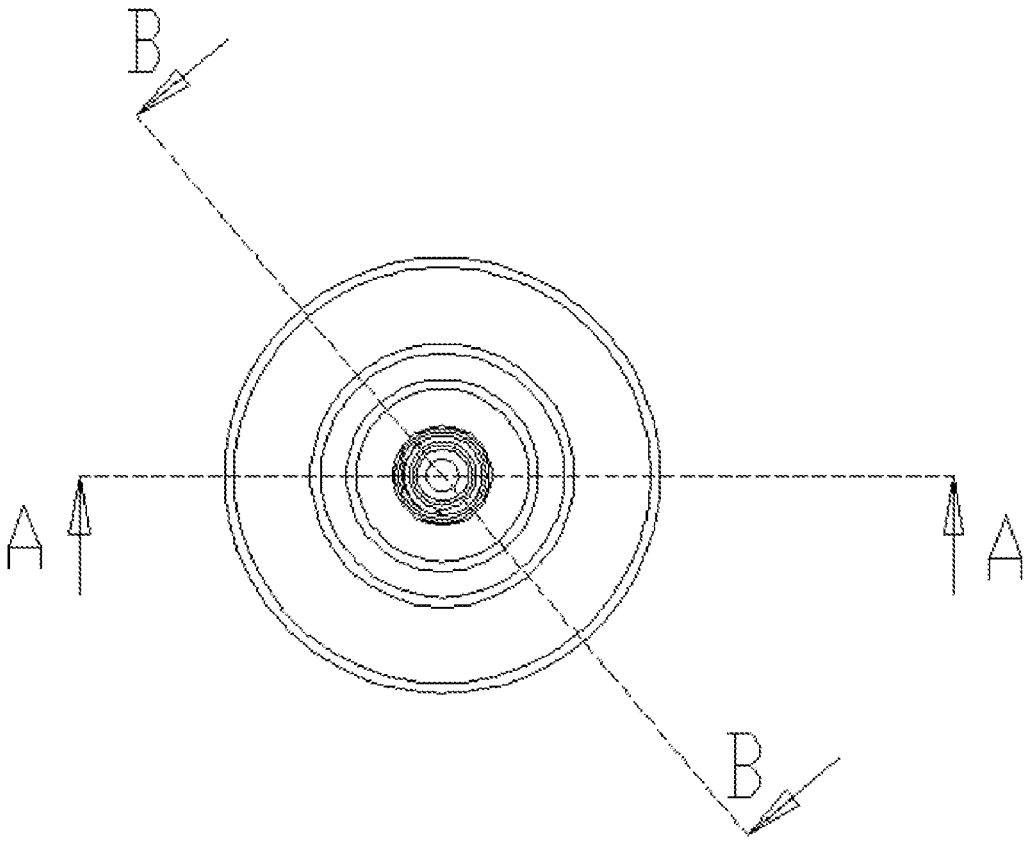
FIG. 3 is a top view of the atomizer according to FIG. 1.
Figure 4:
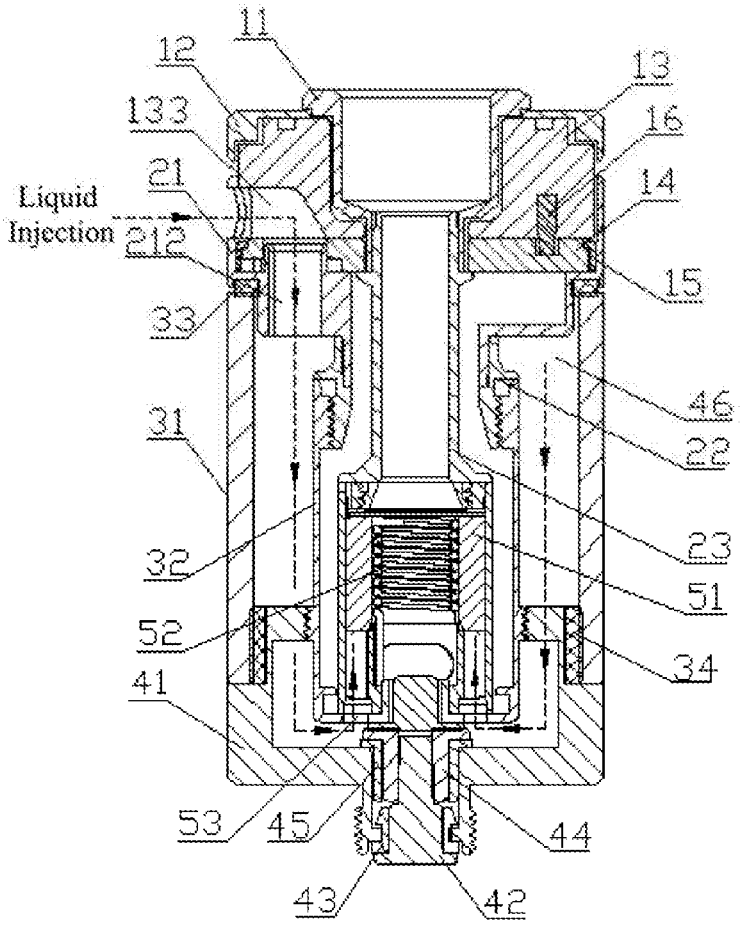
FIG. 4 is a section view along A-A of the atomizer according to FIG. 3.

Referring to FIG. 1, FIG. 2, FIG. 4 and FIG. 5, the liquid storage component 3 of the present embodiment includes an outer sleeve 31 and a bottom component 4. The bottom component 4 is connected to a lower end of the outer sleeve 31. Specifically, the bottom component 4 includes a lower cover 41, a silicone sealing ring 34 and an electrode connection component. Preferably, referring to FIG. 2 and FIG. 4, the electrode connection component of this embodiment includes a first electrode contact 42, a sealing ring 43, a second electrode contact 44, and an insulation ring 45. The bottom of the lower cover 41 has a through hole, and the outside of the first electrode contact 42 is sleeved in the sealing ring 43 and is stuck in the bottom of the through hole, while the outside of the second electrode contact 44 is sleeved in the insulation ring 45 and is stuck into the top of the through hole, where the first electrode contact 42 and the second electrode contact 44 need to maintain the electrical connection. The electrical connection manner in which the two electrode contacts shown in FIG. 4 is to make the first electrode contact 42 and the second electrode 44 directly sleeved and connected, which is convenient for assembly and improves the assembly efficiency. Of course, other manners, such as a connection with wires, may also be used.

Referring to FIG. 1 to FIG. 4, in the present embodiment, the liquid storage component 3 has a liquid storage chamber 46. The liquid storage chamber 46 is mainly surrounded by the outer sleeve 31 and the bottom component 4. Both ends of the outer sleeve 31 are open-plan, the bottom component 4 seals the lower end of the outer sleeve 31 while the upper end of the outer sleeve 31 is sealed by the switching device 1. Specifically, the switching device 1 further includes a connection component 2 connected at a lower end thereof. The connection component 2 specifically includes a connector 21 arranged on the peripheral side of the static piece 14. The connector 21 connects to the switching device 1 with the atomization component. The connector 21 is fixedly connected with the upper end of the outer sleeve 31, and a sealing device 33 is disposed on the joint between the connector 21 and the outer sleeve 31. The sealing device 33 can prevent the smoke liquid in the liquid storage chamber 46 from seeping out from the gap between the connector 21 and the outer sleeve 31. Specifically, the sealing device 33 can be a silicone ring or other sealing film, etc. Preferably, referring to FIG. 2 and FIG. 4, a lining ring 15 is also disposed between the contact surfaces of the connector 21 and the static piece 14, where the lining ring 15 may be made of silicone or rubber material, and the lining ring 15 can reduce the wear on the static piece 14 caused by the connector 21 and can also make the static piece 14 fixedly disposed in the connector 21 so as to prevent the static piece 14 from sliding arbitrarily.

Figure 11:
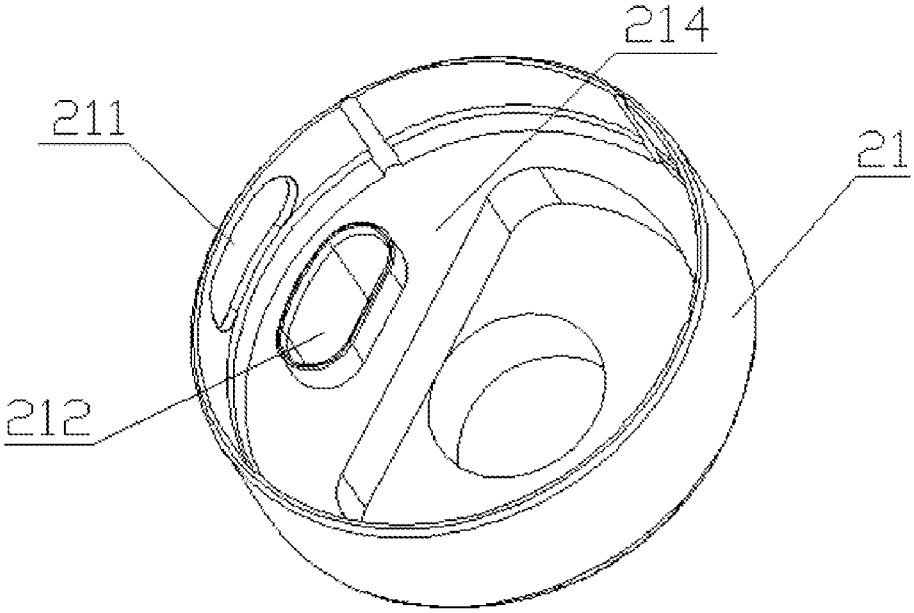
FIG. 11 is a stereogram of a connector according to the present application.

Referring to FIG. 11, the connector 21 includes a concave cavity 214. The static piece 14 is fixedly disposed in the concave cavity 214. For example, the static piece 14 can be stuck into the concave cavity 214 by interference, and a connector positioning hole 212 is disposed on an inner wall surface of the lower end of the concave cavity 214. The concave cavity 214 and the liquid storage chamber 46 communicate with each other via the connector positioning hole 212. Referring to FIG. 4 and FIG. 10, in the present embodiment, the static piece 14 is fixedly disposed in the concave cavity 214 in such a way that the connector positioning hole 212 protrudes from the inner wall surface of the lower end of the concave cavity 214, so that the edge of the connector positioning hole 212 is not on the same plane as the inner wall surface of the lower end of the concave cavity 214. With a certain height, the static piece liquid inlet 142 can sleeve the periphery of the connector positioning hole 212.

Figure 6:
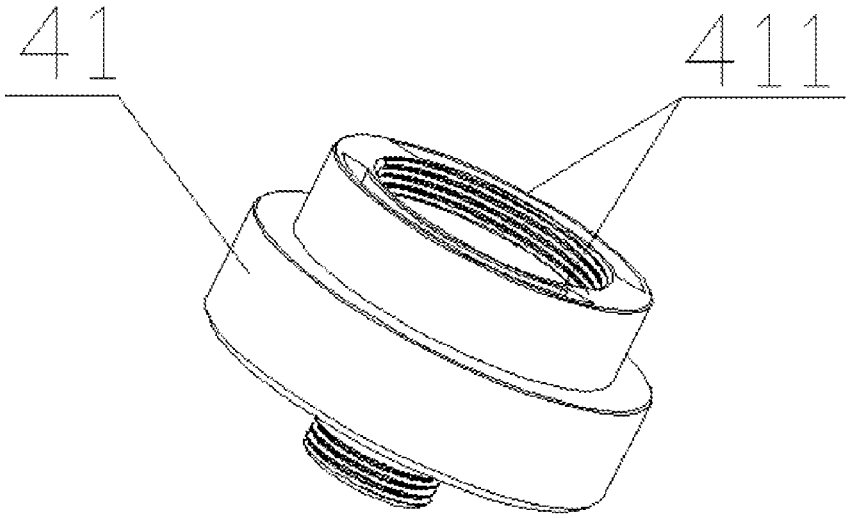
FIG. 6 is a stereogram of a lower cover according to the present application.
Figure 7:
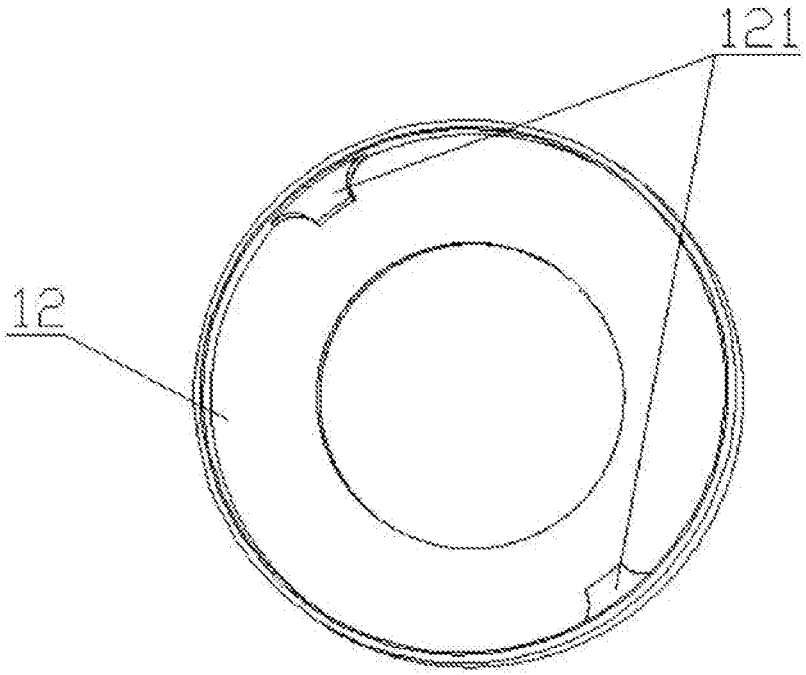
FIG. 7 is a stereogram of an adjusting ring according to the present application.

Referring to FIG. 6, in order to better utilize the internal space of the atomizer 100 and expand the liquid storage capacity of the liquid storage chamber 46, according to a preferred embodiment of the present embodiment, the surface of the upper end of the lower cover 41 is provided with a smoke liquid groove 411. The injected smoke liquid in the liquid storage chamber 46 enters the atomization head 5 through the smoke liquid groove 411 and the liquid inlet 53 disposed on the atomization head 5, and is absorbed by the liquid absorption part 51 of the atomization head 5 so as to be heated by a heat generating part 52 to perform the atomization process.

Figure 5:
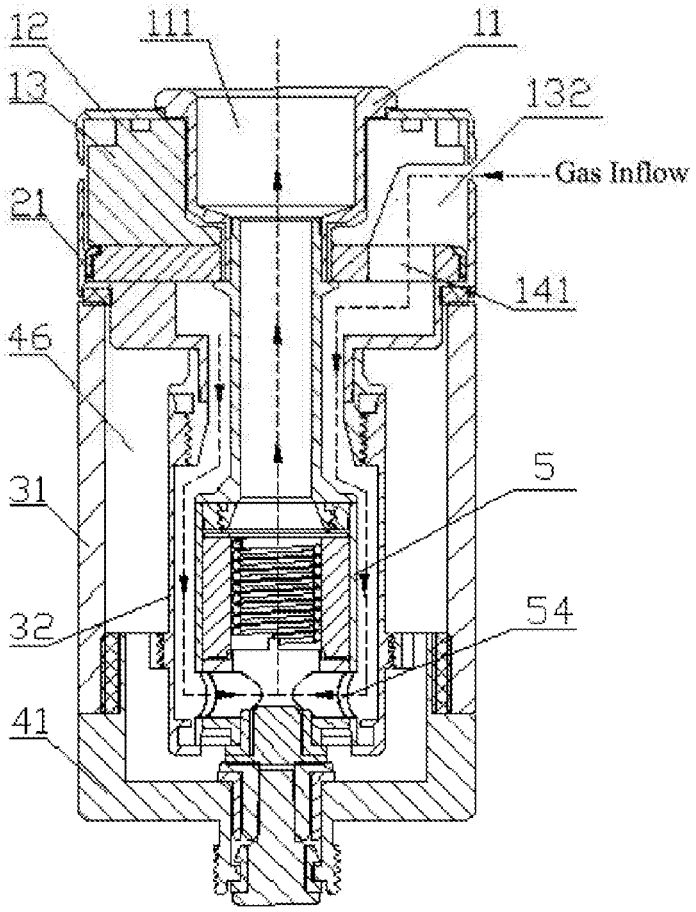
FIG. 5 is a section view along B-B of the atomizer according to FIG. 3.

Referring to FIG. 4 and FIG. 5, the atomization component of the present embodiment includes an atomization head 5, a vent pipe 23, and an atomization sleeve 32. The atomization head 5 is sleeved in the atomization sleeve 32, and the upper end of the atomization head 5 is fixedly connected with the lower end of the vent pipe 23. The lower end of the atomization head 5 is electrically connected with the electrode connection component. Preferably, according to a preferred implementation of the present embodiment, the vent pipe 23 traverses the connector 21, the static piece 14, and the movable piece 13 and is fixedly connected to the lower end of a cigarette holder connector 11; the vent pipe 23 connects a smoke gas channel of the atomization head 5 to a smoke outlet 111 of the cigarette holder connector 11; and the upper end of the atomization sleeve 32 is connected, through threads, to a thread connection ring 22 that is fixedly disposed at the lower end of the connector 21. The atomization head 5 can be replaced by only separating the atomization component as a whole from the electronic cigarette, and then stripping the atomization sleeve 32 from it.

Referring to FIG. 5, FIG. 9 and FIG. 10, the gas inflow manner of the present embodiment is that the atomizer 100 is switched to the state of gas inflow adjustment by the switching device 1, and the external gas enters the gap between the atomization sleeve 32 and the atomization head 5 through the gap between the adjusting ring 12 and the connector 21, the movable piece gas inlet 132 provided on the movable piece 13, the static piece gas inlet 141 provided on the static piece 14, and the concave cavity 214 of the connector 21, thus finally entering the atomization head 5 through the gas flow inlet 54 provided on the atomization head 5 to participate in the atomization. Specifically, in conjunction with FIG. 4, the heat generating part 52 heats the smoke liquid to make the smoke liquid atomized, and the external gas enters the atomization head 5 through the gas flow inlet 54 and takes away the atomized smoke liquid. Then the atomized smoke liquid is smoked by the user through smoke gas channel of the atomization head 5, the vent pipe 23 and the smoke outlet 111 of the cigarette holder connector 11.

Referring to FIG. 5, that the atomizer 100 is in the state of gas inflow adjustment, which is mentioned above, refers to continuing to operate the switching device 1, and may specifically be continuing to rotate the adjusting ring 12 to drive the movable piece 21 to rotate, changing the communication area of the movable piece gas inlet 132 and the static piece gas inlet 141, so as to change the flow of external gas passing through per unit time, thereby achieving gas inflow adjustment. Further, in order to overcome the problem of the residual smoke liquid due to the excessive absorption of smoke liquid by the atomization head 5, which tends to cause an abnormal purring sound during using and be easily inhaled by the user, this embodiment designs relative positions for the liquid inlets and the gas inlets so that when the atomizer 100 is in the state of liquid injection, the connector liquid inlet 211, the movable piece liquid inlet 133, the static piece liquid inlet 142, and the connector positioning hole 212 communicate with each other, and the movable piece gas inlet 132 and the static piece gas inlet 141 are staggered to be closed, so that the gas inflow channel of the atomization head 5 is closed, thereby avoiding the case that during the liquid injection, smoke liquid may be absorbed by the liquid absorption part 51 excessively and may leak out due to a possible pressure difference, for the reason that the gas inflow channel of the atomization head 5 is open as well and communicates the smoke gas channel of the atomization head 5. Therefore, in the present embodiment, the gas inflow channel of the atomization head 5 is closed during the liquid injection, so as to ensure that the liquid absorption part 51 does not excessively absorb smoke liquid. It can be understood that, when the atomizer 100 is in the state of gas inflow adjustment, the movable piece liquid inlet 133 and the static piece liquid inlet 142 are closed, while the movable piece gas inlet 132 and the static piece gas inlet 141 communicate with each other. A further rotation of the adjusting ring 12 can adjust the communication area of the movable piece gas inlet 132 and the static piece gas inlet 141.

Figure 12:
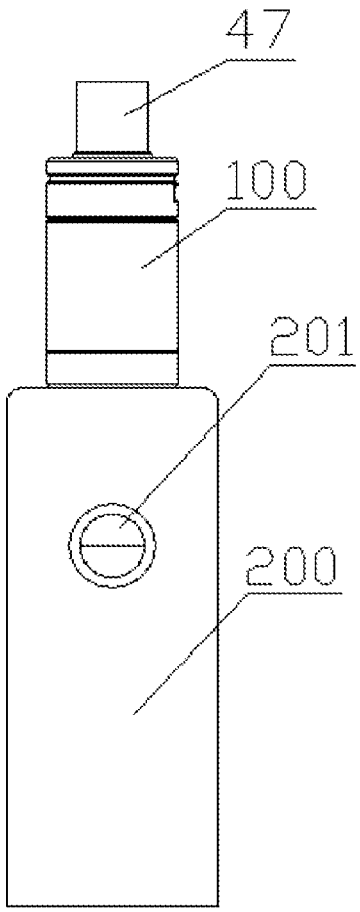
FIG. 12 is a front view of an electronic cigarette according to the present application.

According to another aspect of the present application, an electronic cigarette is also provided. Referring to FIG. 12, the electronic cigarette includes the atomizer 100 according to any one of the foregoing embodiments. In a preferred embodiment, the electronic cigarette further includes a battery 200 that is connected to the atomizer 100. The battery 200 has a switch 201 for controlling the working state of the atomizer 100. For the purpose of healthy and hygeian smoking, a cigarette holder 47 can be disposed at the upper end of the atomizer 100 detachably to enable the user to replace the cigarette holder 47.

Any combination of various embodiments of the present application, as long as it does not violate the concept of the present application, should be regarded as the content disclosed by the present application; within the scope of the technical idea of the present application, various simple variants of the technical solution and any combination of the different embodiments performed without departing from the concept of the prevent application should fall within the protection scope of the prevent application.

What is claimed is:

1. An atomizer, wherein the atomizer comprises a switching device, a liquid storage component, and an atomization component; wherein the atomization component is disposed in the liquid storage component, and the switching device is disposed at an upper part of the atomization component and seals an open end of the liquid storage component;

the switching device comprises a movable piece and a static piece which are cooperatively arranged, wherein the movable piece is capable of moving relative to the static piece to make the atomizer switch between a state of liquid injection and a state of gas inflow adjustment; the movable piece is provided with a movable piece liquid inlet and a movable piece gas inlet, and the static piece is provided with a static piece liquid inlet and a static piece gas inlet;

wherein when the atomizer is in the state of liquid injection, the movable piece liquid inlet and the static piece liquid inlet communicate with each other, and are connected with the liquid storage component fluidly; the movable piece gas inlet and the static piece gas inlet are staggered to be closed; and when the atomizer is in the state of gas inflow adjustment, the movable piece gas inlet and the static piece gas inlet communicate with each other, and the movable piece liquid inlet and the static piece liquid inlet are staggered to be closed; the movable piece is capable of rotating to change a communication area of the movable piece gas inlet and the static piece gas inlet.

2. The atomizer according to claim 1, wherein the movable piece and the static piece are made of ceramic, and the movable piece is in smooth contact with the static piece.

3. The atomizer according to claim 2, wherein the movable piece and the static piece are connected via a pin; the movable piece is provided with a pin mounting hole/pin sliding groove, and correspondingly the static piece is provided with a pin sliding groove/pin mounting hole, wherein one end of the pin is fixed in the pin mounting hole, and the other end of the pin is capable of reciprocating along the pin sliding groove.

4. The atomizer according to claim 1, wherein the switching device further comprises an adjusting ring disposed on a periphery of the movable piece, the adjusting ring being connected with the movable piece in a relatively static manner; rotation of the adjusting ring drives the movable piece to rotate so as to make the atomizer switch between the state of gas inflow adjustment and the state of liquid injection.

5. The atomizer according to claim 4, wherein the atomizer further comprises a connector that connects the switching device and the atomization component, the connector comprising a concave cavity in which the static piece is fixedly disposed.

6. The atomizer according to claim 5, wherein the liquid storage component comprises a liquid storage chamber; a connector positioning hole is disposed on an inner wall surface of a lower end of the concave cavity; and the concave cavity communicates with the liquid storage chamber through the connector positioning hole.

7. The atomizer according to claim 6, wherein the connector positioning hole protrudes from the inner wall surface of the lower end of the concave cavity, and the static piece liquid inlet sleeves a periphery of the connector positioning hole.

8. The atomizer according to claim 7, wherein the movable piece liquid inlet is disposed on a side wall of the movable piece, and a side wall of the connector is provided with a connector liquid inlet; wherein when the atomizer is in the state of liquid injection, the connector liquid inlet, the movable piece liquid inlet, the static piece liquid inlet and the connector positioning hole communicate, and the movable piece gas inlet and the static piece gas inlet are staggered to be closed.

9. The atomizer according to claim 4, wherein the atomization component comprises an atomization head, a vent pipe, and an atomization sleeve, wherein the atomization head is sleeved in the atomization sleeve; an upper end of the atomization head is fixedly connected with a lower end of the vent pipe, wherein when the atomizer is in the state of gas inflow adjustment, the movable piece liquid inlet and the static piece liquid inlet are staggered to be closed; an external gas enters a gap between the atomization sleeve and the atomization head via a gap between the adjusting ring and a connector, the movable piece gas inlet, the static piece gas inlet and a concave cavity of the connector, then finally enters the atomization head via a gas flow inlet disposed on the atomization head, carries atomized smoke liquid and flows out from the vent pipe.

10. The atomizer according to claim 5, wherein the liquid storage component further comprises an outer sleeve and a bottom component, the bottom component being connected to a lower end of the outer sleeve and comprising a lower cover, a silicone sealing ring and an electrode connection component, wherein the silicone sealing ring is disposed on an upper end of the lower cover so that the lower cover is in interference connection with the outer sleeve, and the electrode connection component is disposed at a lower end of the lower cover to electrically connect the atomization component with a power supply.

11. The atomizer according to claim 10, wherein the connector is disposed at an upper end of the outer sleeve, and a sealing device is disposed between the connector and the outer sleeve.

12. The atomizer according to claim 10, wherein a smoke liquid groove is disposed on a surface of the upper end of the lower cover, and the liquid storage chamber and the atomization component communicate with each other via the smoke liquid groove.

13. The atomizer according to claim 10, wherein the atomization component comprises an atomization head, a vent pipe, and an atomization sleeve, wherein the atomization head is sleeved in the atomization sleeve; an upper end of the atomization head is fixedly connected with a lower end of the vent pipe; and a lower end of the atomization head is electrically connected with the electrode connection component.

14. The atomizer according to claim 13, wherein the vent pipe traverses the connector, the static piece and the movable piece, and is fixedly connected with a lower end of a cigarette holder connector; a smoke gas channel of the atomization head and a smoke outlet of the cigarette holder connector communicate via the vent pipe.

15. The atomizer according to claim 13, wherein a gas flow inlet is disposed on a side wall of the atomization head; when the atomizer is in the state of gas inflow adjustment, the movable piece gas inlet and the static piece gas inlet communicate with the gas flow inlet, and the connector liquid inlet and the movable piece liquid inlet are staggered to be closed.

16. An electronic cigarette, wherein the electronic cigarette comprises the atomizer according to claim 1.

* * * * *